US005420495A

United States Patent [19]

Hingorani

[11] Patent Number: 5,420,495

[45] Date of Patent: May 30, 1995

[54] TRANSMISSION LINE POWER FLOW CONTROLLER

[75] Inventor: Narain G. Hingorani, Los Altos Hills, Calif.

[73] Assignee: Electric Power Research Institute, Inc., Palo Alto, Calif.

[21] Appl. No.: 48,858

[22] Filed: Apr. 19, 1993

[51] Int. Cl.[6] ..... G05F 1/00

[52] U.S. Cl. ..... 323/218; 323/352

[58] Field of Search ..... 323/208, 209, 210, 211, 323/218, 293, 352, 356; 307/127

[56] References Cited

U.S. PATENT DOCUMENTS

| | | | |
|---|---|---|---|
| 3,538,352 | 11/1970 | Jun-Ichi Nishizawa | 307/265 |
| 3,544,734 | 12/1970 | Meacham | 179/170 |
| 3,828,281 | 8/1974 | Chambers, Jr. | 333/17 |
| 3,835,364 | 9/1974 | Van Rooy | 321/2 |
| 4,121,271 | 10/1978 | Tsai | 361/82 |
| 4,607,243 | 8/1986 | Dreier | 333/214 |
| 4,697,132 | 9/1987 | Ronk et al. | 318/795 |
| 4,728,887 | 3/1988 | Davis | 324/127 |
| 4,792,887 | 12/1988 | Bernitz et al. | 363/89 |
| 4,806,855 | 2/1989 | Davis | 324/127 |
| 4,814,559 | 3/1989 | Stegmüller . | |
| 4,933,798 | 6/1990 | Widmayer et al. . | |
| 4,963,845 | 10/1990 | Collier | 333/214 |
| 5,227,713 | 7/1993 | Bowler et al. | 322/58 |

*Primary Examiner*—Steven L. Stephan
*Assistant Examiner*—Shawn Riley
*Attorney, Agent, or Firm*—Flehr, Hohbach, Test, Albritton & Herbert

[57] ABSTRACT

A transmission line power flow control system and method selectively reverses power flow direction and controls power flow level over a transmission line. A capacitor having a variable capacitive impedance is selectively inserted in series with the line. The capacitor has a maximum capacitive impedance magnitude which exceeds the magnitude of the inductive impedance of the transmission line. A switching device in parallel with the capacitor inserts and removes the capacitor from the line. The capacitor maybe inserted and removed in a stepwise fashion using several modules, or in a gradual fashion by using inductors in series with the modular switching devices. In response to measurements of power flow parameters, such as line current and line to ground voltages, a controller controls the switching device(s) to selectively vary the net impedance of the transmission line to control the direction and magnitude of power flow therethrough.

5 Claims, 2 Drawing Sheets

TRANSMISSION LINE POWER FLOW CONTROLLER

BACKGROUND OF THE INVENTION

The present invention relates generally to a power flow control system for controlling the power flow level over a transmission line, and more particularly to a power flow control system and a method for reversing the direction of power flow through the transmission line.

A typical power transmission system is shown as a single line schematic diagram in FIG. 6. FIG. 7 shows a phasor diagram of the power parameters of the FIG. 6 system. For the purposes of discussion herein, a "positive power flow" refers to a power flow through a transmission line L from a first voltage source $V_1$ toward a second voltage source $V_2$, and a reverse or negative power flows in the opposite direction. This positive power flow direction is also illustrated in FIG. 6 by the direction of the arrow corresponding to a line current I flowing through the transmission line L. The transmission line L is an alternating current (AC) line having an impedance $Z_L$ which is dominantly inductive or positive.

Power flow P through the transmission line L is, to a good approximation, governed by the equation:

$$P=(V_1V_2 \sin \delta_{12})\div(-Z)$$

In this equation, $V_1$ and $V_2$ are the two line-end voltages shown in FIGS. 6 and 7, $\delta_{12}$ a phase angle between the $V_1$ and $V_2$ voltages, and Z is the net series impedance of the line L.

One earlier manner of controlling power flow over the transmission line L controls the net series impedance Z of the line. Since the natural impedance of a transmission line is inductive ($Z_L$), one or more series capacitors having a capacitive impedance $Z_C$ are sometimes used to decrease the inductive impedance $Z_L$ of the line. Such series capacitors are switched in and out of series with the transmission line in steps to vary the net inductive impedance Z of the transmission line L.

Under the present state of the art, rather than a stepwise insertion, the value of the series capacitor can also be controlled smoothly by coupling the series combination of a reactor and a thyristor switch (not shown) in parallel with the capacitor. By controlling the firing angle of the thyristor, the apparent impedance of the capacitor can be smoothly varied. For economic reasons, combinations of stepped and variable capacitor assemblies have sometimes been used to accomplish the required range of impedance. Thus, the series capacitance may be inserted in a stepped variable or a gradually variable fashion, or in a combination thereof.

These earlier systems are limited to controlling the level of power flow in only a single direction, specifically, from $V_1$ to $V_2$ when the $V_1$ voltage is leading the $V_2$ voltage, as shown in FIG. 7. In these earlier systems, the only way to reverse the direction of power flow from $V_2$ to $V_1$ is to reverse the phase angle $\delta_{12}$, so that the second voltage $V_2$ leads the first voltage $V_1$, shown in dashed lines in FIG. 7 as vector $V_1'$. The only practical manner of reversing the phase angle, shown as angle $-\delta_{12}$, is to make significant changes in the power generation schemes of the voltage sources $V_1$ and $V_2$.

These major generation changes are quite impractical and not easily satisfied in complex power systems.

One severe limitation of the earlier system of FIG. 6 is that the phase angle $\delta_{12}$ drifts back and forth, such as from $+\delta_{12}$ to $-\delta_{12}$ as shown in FIG. 7. This unpredictable drifting of the phase angle leads to random and undesired changes in the power flow direction.

Another earlier proposed system includes a phase angle regulator. However, these regulators are expensive, and have high losses, as well as other disadvantages. Moreover, phase angle regulators are not cost effective for many applications.

Another system proposed for controlling power flow uses high voltage direct current (HVDC) equipment (not shown) coupled to the transmission line L. In an HVDC implementation, power flow is controlled independent of the value of the phase angle $\delta_{12}$. A significant drawback to the HVDC implementation is its expense, in terms of both initial installation and operational costs, so the HVDC implementation is simply not cost effective for many applications.

Thus, a need exists for an improved power flow control system, comprising an apparatus and a method, for selectively controlling the direction of power flow over a transmission line, which is directed toward overcoming, and not susceptible to, the above limitations and disadvantages.

SUMMARY OF THE INVENTION

According to one aspect of the present invention, a power flow control system for selectively controlling the flow of power in either direction over a transmission line includes a capacitor having a variable capacitance for inserting in series with the transmission line. The system has one or more sensors for monitoring power flow parameters of the power flowing through the transmission line. A controller is responsive to the sensor or sensors for varying the capacitance of the capacitor. The system has a switching device responsive to the controller for selectively coupling the capacitor to the transmission line to vary an impedance of the transmission line. In this manner, the system controls the direction of power flow through the transmission line.

According to another aspect of the present invention, a method of controlling power flow in either direction between first and second power systems is provided. The power systems each have a voltage, and the voltages are separated by a phase angle with a first polarity. A transmission line having a line impedance couples the first and second power systems together. The method includes the steps of monitoring a parameter of power flowing through the transmission line, and in response to the monitoring step, selectively coupling a variable capacitive impedance to the transmission line. In a varying step, the capacitive impedance is varied, in a stepwise fashion or smoothly, to vary the line impedance to control the direction of power flow between the first and second power systems while maintaining the first polarity of the phase angle.

An overall object of the present invention is to provide a power flow control system and a method for selectively controlling the flow of power in either direction over a transmission line.

A further object of the present invention is to provide a power flow control system and a method for reversing the direction of power flow over a transmission line while maintaining a phase angle, without reversal, between the voltages of two power systems located at opposite ends of the line.

Another object of the present invention is to provide a transmission line power flow control system which is economical to install and operate.

Another object of the present invention is to provide a transmission line power flow control system for reversing the direction of power flow over a transmission line without disrupting the power generation scheme of a power system coupled to the transmission line.

The present invention relates to the above features and objects individually as well as collectively. These and other objects, features and advantages of the present invention will become apparent to those skilled in the art from the following description and drawings.

DETAILED DESCRIPTION OF A PREFERRED EMBODIMENT

Figure 1:
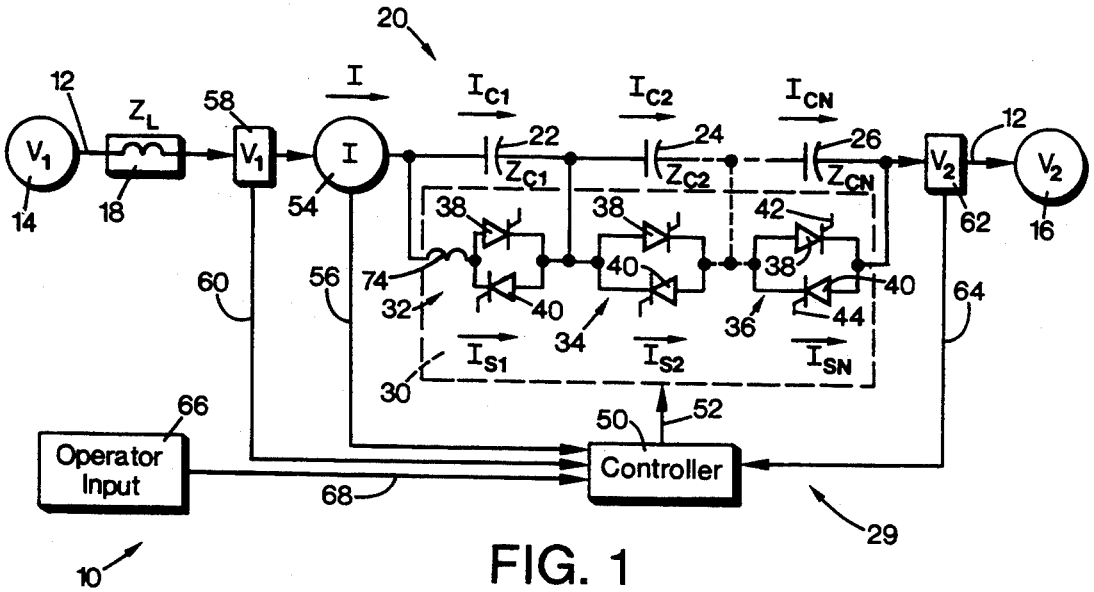
FIG. 1 is a single line schematic block diagram of one form of a transmission line power flow control system of the present invention.

FIG. 1 illustrates an embodiment of a transmission line power flow control system 10 constructed in accordance with the present invention for controlling the power flow magnitude and direction over a transmission line 12. The transmission line 12 is coupled between first and second AC power generation systems 14 and 16. The power systems 14 and 16 each have respective voltages $V_1$ and $V_2$, and are occasionally referred to herein as voltage sources $V_1$ and $V_2$. The transmission line 12 may be a conventional polyphase power transmission line having a substantially inductive impedance $Z_L$, illustrated as coil 18 in series with the transmission line 12.

Regarding terminology used herein, the term "positive power flow" or "forward power flow" refers to power flowing through line 12 from voltage source $V_1$ toward voltage source $V_2$, and a "reverse" or "negative" power flows in the opposite direction. The positive power flow direction is also indicated by the direction of a line current I flowing through the line 12. An inductive impedance, such as $Z_L$, is a positive impedance, and a capacitive impedance is a negative impedance.

The system 10 includes a negative impedance device or variable capacitive impedance, such as a series capacitor 20. The series capacitor 20 has one or more series connected discrete capacitor modules, such as capacitors 22, 24 and 26. While for the purposes of illustration, only three capacitor modules are shown, the ability to adapt the capacitor 20 to include additional capacitor modules is illustrated by the dashed lines coupling together modules 24 and 26. While only a single capacitor is shown for each module 22–26, it is apparent to those skilled in the art that each capacitor module may include one or more capacitors (not shown). The capacitor modules 22, 24 and 26 have respective capacitive impedances $Z_{C1}$, $Z_{C2}$, and $Z_{VN}$, which may be of the same or different capacitances.

The control system 10 has a controlled switching device 29 including a switching device 30. The switching device 30 has one or more series connected switches, illustrated as three thyristor valves 32, 34 and 36. Each thyristor valve 32, 34 and 36 has at least two antiparallel thyristors, such as thyristors 38 and 40. As shown for valve 36, thyristors 38 and 40 trigger into a conducting state upon receiving a firing command signal through the conductors 42 and 44, respectively. The thyristors 38 and 40 of each valve 32, 34 and 36 may be conventional thyristors, gate turnoff thyristors (GTO), metal oxide silicon (MOS) controlled thyristors (MCT), or combinations thereof, known to be structurally equivalent by those skilled in the art.

Regarding terminology used herein, a thyristor valve enters a conducting state when the antiparallel thyristors are each turned "on." This conducting state is also referred to as the switch being "closed." Conversely, a thyristor valve enters a nonconducting state when the antiparallel thyristors are each turned "off." This nonconducting state is also referred to as the switch being "opened."

Each of the thyristor valves 32, 34 and 36 is in parallel with a corresponding capacitor module 22, 24 and 26, respectively. When the thyristor valves receive a firing command signal, the line current is bypassed around the capacitor module and through the switch. For example, to insert only the first capacitor module 22 in series with the transmission line 12, the thyristor valve 32 is turned off, and values 34 and 36 are turned on to bypass current around capacitor modules 24 and 26. The line current I flows through the control system 10 as a current $I_{C1}$ through the capacitor module 22, and then is bypassed around capacitor modules 24 and 26 as switch currents $I_{S2}$ and $I_{SN}$ before returning to the transmission line 12.

To dictate when and which thyristor valves 32, 34 or 36 are turned on or turned off, the controlled switching device 29 includes a controller 50 for supplying a firing command signal 52 to the switching device 30. The firing command signal 52 contains firing command signals, such as 42 and 44, for each of the thyristors 38 and 40 to control valves 32, 34 and 36. The controller 50 receives one or more signals corresponding to parameters of the power flowing through transmission line 12.

For example, a line current sensor 54 monitors the line current I flowing through the transmission line 12, and in response thereto produces a line current sensor signal 56 which is delivered to controller 50. First and second voltage sensors are also provided. A $V_1$ voltage sensor 58 monitors the $V_1$ voltage of the power system 14, and in response thereto, provides a $V_1$ voltage sensor signal 60 to controller 50. A $V_2$ voltage sensor 62 monitors the $V_2$ voltage of power system 14, and in response thereto, provides a $V_2$ voltage sensor signal 64 to the controller 50. As a further input to the controller 50 is provided by an operator input portion 66. For example, an operator of the power system 14 or 16 uses the operator input portion 66 to provide an operator input signal 68 to controller 50 to control the system 10. The operation of the controller 50 is described further below.

In earlier systems discussed above, a forward or positive power flow from the $V_1$ source to the $V_2$ source occurs only when the $V_1$ voltage is leading the $V_2$ voltage. Power reversal, or negative power flow from the $V_2$ source to the $V_1$ source is only possible in the earlier system when the phase angle is reversed and voltage $V_2$ leads $V_1$.

Figure 2:
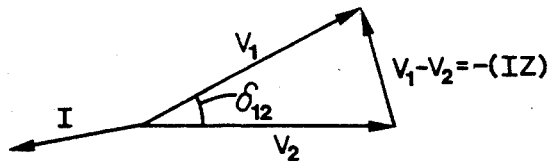
FIG. 2 is a phasor diagram of one manner of operating the FIG. 1 system.
Figure 7:
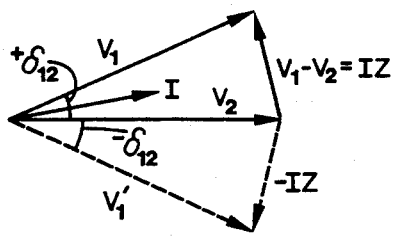
FIG. 7 is a phasor diagram of the power system parameters of the earlier system of FIG. 6.

In contrast, as shown in FIG. 2, the control system 10 achieves reverse power flow when the $V_1$ voltage is leading the $V_2$ voltage, while maintaining (rather than reversing) the polarity of the phase angle $\delta_{12}$. The control system 10 also provides forward power flow when the phase angle $\delta_{12}$ is reversed, and the voltage $V_2$ is leading the voltage $V_1$. This power flow reversal is apparent from a comparison of the phasor diagrams in FIGS. 2 and 7. In FIG. 7, the net line impedance Z is dominantly inductive due to the natural inductance $Z_L$ of the transmission line L. In FIG. 2, the phasor diagram illustrates this reverse current flow (phasor I) when the net impedance Z of the transmission line is substantially capacitive, and thus negative.

To achieve these results, the control system 10 adds series capacitance compensation to the transmission line 12, such that the level of series capacitor compensation exceeds the total inductive impedance $Z_L$ of the transmission line 12. By adding series capacitance to the transmission line 12, to the point where the capacitance is the dominant component of the line impedance, the net series line impedance becomes negative. Furthermore, the line current amplitude, given by the equation:

$$I=(V_1-V_2)\div Z,$$

where, $$Z=Z_L-Z_C,$$

does not exceed a desired current limit because the dominant capacitive impedance produces a net series line impedance of a sufficient magnitude to limit the line current I.

The capacitive compensation may be increased by adding the capacitive impedances $Z_{C1}$, $Z_{C2}$, and $Z_{CN}$ into series with the transmission line 12 by sequentially turning off the thyristor valves 32, 34 and 36. The total series capacitive compensation ($Z_C=Z_{C1}+Z_{C2}+Z_{CN}$) may be well in excess of the 100% value of the series inductive impedance $Z_L$ of line 12. As the negative capacitive compensation is increased, it cancels the positive inductive line impedance $Z_L$.

Figure 4:
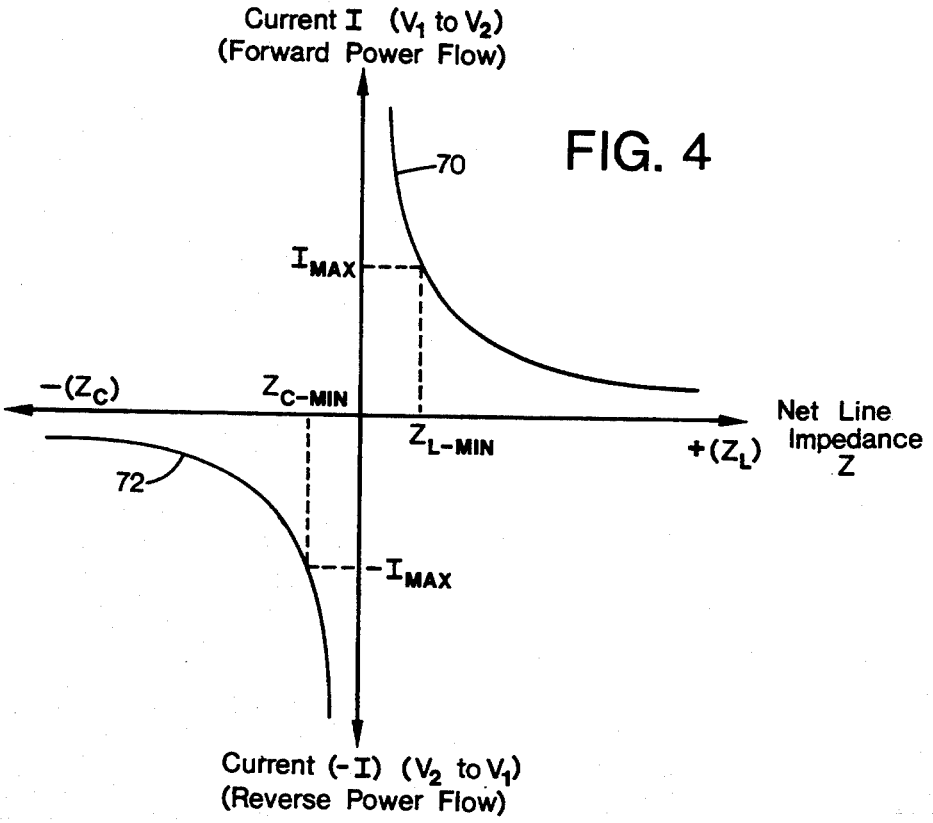
FIG. 4 is a graph illustrating operation of the FIG. 1 system.
Figure 3:
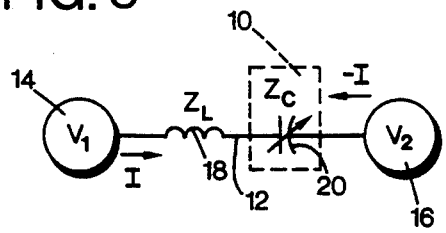
FIG. 3 is a single line diagram showing the power flow of the FIG. 1 system in a simplified form.

Referring to FIGS. 3 and 4, the relationship between the net line impedance Z and the current flow I is shown. FIG. 3 is a simplified single line schematic diagram showing the power systems 14, 16 and the line impedances $Z_L$ and $Z_C$. In the FIG. 4 graph, on the positive impedance ($Z_L$) side, the capacitive modules are blocked, or bypassed through firing of the thyristor valves 32, 34, 36 to increase the positive impedance. On the negative impedance ($Z_C$) side of the graph, the negative impedance is increased by sequentially unblocking the capacitive modules 22, 24, 26 by turning off the thyristor valves 32, 34, 36.

A positive current flow curve 70 shown in FIG. 4 is produced when the voltage $V_1$ leads the voltage $V_2$, and the inductive impedance is greater than the capacitive impedance ($\omega L>(\omega C)^{-1}$). A negative current flow, corresponding to a reverse power flow, is shown by curve 72. This reverse power flow curve 72 occurs when the voltage $V_1$ leads the voltage $V_2$, and the net impedance Z of the line is capacitive ($\omega L<(\omega C)^{-1}$).

As the absolute value of the net impedance Z decreases, as shown by curves 70 and 72, the magnitude of the line current I increases. Indeed, the line current I increases at a much faster rate as the net line impedance Z approaches zero. To control the current I, as described further below, the controller 50 monitors the line current I and in response thereto controls the rate of change of the line impedance Z so the line current I remains within safe limits.

FIG. 4 also illustrates positive and negative current maximums limits, $I_{MAX}$ and $-I_{MAX}$, which represent the maximum current carrying capability of the transmission line 12 and its related components, such as power transformers, breakers and the like. To maintain the line current within acceptable limits, the net impedance if inductive, must be greater than the value $Z_{L\text{-}MIN}$, and if capacitive, the net impedance must be less than the value $Z_{C\text{-}MIN}$. In effect, the net line impedance between the $Z_{C\text{-}MIN}$ and $Z_{L\text{-}MIN}$ values represents an impedance deadband for the control system 10. The controller 50 determines the magnitude of the inserted capacitive impedance $Z_C$ which compensates for the inductive impedance $Z_L$, and which also brings the net impedance Z to a value less than a minimum capacitive impedance $Z_{C\text{-}MIN}$.

Referring to FIG. 1, one or more of the thyristor valves 32, 34 and 36 may also have an inductance in series, such as inductor 74 in series with thyristors 38 and 40 of valve 32. Inserting one or more inductors in series with the valves provides the system 10 with the capability of a smooth variable change in the impedance of the capacitor modules having the inductors.

Figure 5:
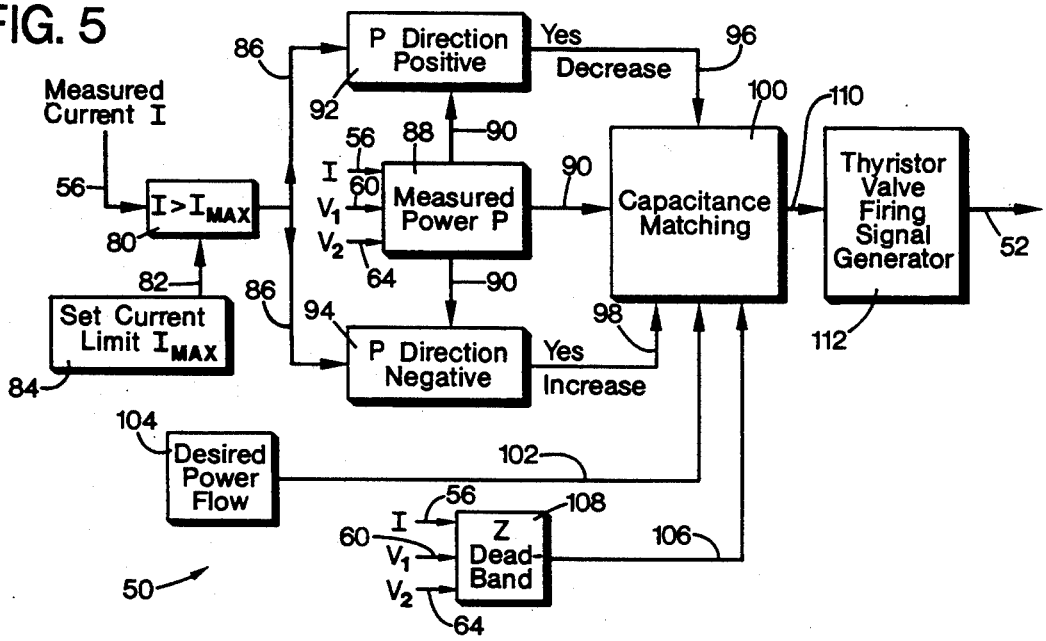
FIG. 5 is a block diagram of one form of the controller of FIG. 1.
Figure 6:
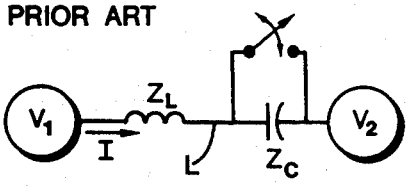
FIG. 6 PRIOR ART
FIG. 6 is a single line schematic diagram of an earlier power flow control system.

Referring to FIG. 5, an illustrated embodiment of the controller 50 has a line current limiter 80 which receives the measured line current signal 56 from sensor 54 and a maximum current magnitude limit or $I_{MAX}$ signal 82. The $I_{MAX}$ signal 82 is provided by a set current limit input device 84, which sets a maximum current limit $I_{MAX}$ below the maximum safe level to provide the control system 10 with a design safety factor. The current limiter 80 compares the line current signal 56 with the maximum current magnitude $I_{MAX}$ signal 82. If the line current I exceeds the maximum current limit $I_{MAX}$, the current limiter 80 produces a check power flow direction signal 86. The current limit input device 84 may be a portion of the controller 50. Alternatively, the input device 84 may be located at the operator input station 66 where the operator input signal 68 includes the maximum current magnitude limit signal 82.

The controller 50 has a power measurement portion 88 which receives the line current signal 56 from sensor 54, the $V_1$ voltage signal 60 from sensor 58, and the $V_2$ voltage signal 64 from sensor 62. From these three inputs, the power measurement portion 88 calculates the power flow through the transmission line 12 to produce a power flow direction signal 90. A positive power flow direction portion 92, and a negative power flow direction portion 94, each receive the power flow direction signal 90. Upon receiving the check power flow direction signal 86, the positive and negative power flow direction portions 92 and 94 determine whether the power flow direction is positive or negative. If the positive direction portion 92 determines that the power is undesirably flowing from the $V_1$ power system 14 to the $V_2$ power system 16, it produces a decrease series capacitance command signal 96. If the negative direction portion 94 determines the power flow is undesirably reversed with power flowing from the $V_2$ power system 16 to the $V_1$ power system 14, it generates an increase series capacitance command signal 98.

The controller 50 has a capacitance matching portion 100 which receives the decrease and increase series capacitance signals 96 and 98 and the measured power signal 90. The desired capacitance matching portion 100 also receives a selected power flow signal 102 from a desired power flow establishing portion 104. The desired power flow signal 102 corresponds to the a selected or desired direction and magnitude of power flow through the transmission line 12. The establishing portion 104 may be a part of the controller 50, and may operate automatically to regulate power flow on a daily or seasonal basis, based on anticipated power requirements of the power generation systems 14 and 16. Alternatively, the establishing portion 104 may be a part of the operator input portion 66, with the operator input signal 68 including the desired power flow signal 102.

The capacitance matching portion 100 receives an impedance deadband signal 106 from an impedance deadband determining portion 108. As shown in FIG. 4, the impedance deadband is between the $Z_{C\text{-}MIN}$ and $Z_{L\text{-}MIN}$ values. However, the impedance deadband continually varies during operation because the current flow I is also a function of the phase angle $\delta_{12}$ and voltages $V_1$ and $V_2$ (see FIG. 2). To determine the impedance deadband signal 106, the determining portion 108 receives the line current signal 56 from sensor 54, the $V_1$ voltage signal 60 from sensor 58, and the $V_2$ voltage signal 64 from sensor 62. From these inputs, the determining portion 108 determines the impedance deadband between the minimum capacitive and inductive impedances, $Z_{C\text{-}MIN}$ and $Z_{L\text{-}MIN}$.

The capacitance matching portion 100 responds to the power flow direction signal 90, the desired power flow signal 102, the impedance deadband signal 106, and the decrease and increase series capacitance command signals 96 and 98, to determine which capacitive impedances $Z_{C1}$, $Z_{C2}$, and/or $Z_{CN}$ must be inserted in series with the transmission line 12 to produce the desired power flow established by portion 104 while not exceeding the maximum current magnitude. From these inputs, the matching portion 100 produces a series capacitance signal 110 which is supplied to a thyristor valve firing signal generator 112 for producing the firing command signal 52.

It is apparent that line current limiter 80, the set current limit input device 84, the power measurement portion 88, the positive power flow direction portion 92, the negative power flow direction portion 94, the capacitance matching portion 100, the power flow establishing portion 104, the impedance deadband determining portion 108, and the thyristor valve firing signal generator 112 may be implemented in software, hardware, or combinations thereof, known to be structurally equivalent by those skilled in the art.

The firing command signal 52 directs selected thyristors valves 32, 34 and/or 36 to turn on to remove selected capacitor modules 22, 24 and/or 26 from the transmission line to decrease the series capacitance, or to turn off to increase the series capacitance. For example, to limit the line current I within $I_{MAX}$ established by the set current limit input device 84, for a positive power flow, the thyristor valves 32, 34 and/or 36 are selectively triggered to fire to block the insertion of any additional capacitance modules 22, 24 and/or 26 into the transmission line 12. In this manner, the net positive impedance $Z_L$ is prevented from reaching a value beneath $Z_{L\text{-}MIN}$, as shown in FIG. 4.

When the establishing device 104 requires a reverse power flow from the $V_2$ source to $V_1$ source the capacitance matching portion 100 determines the appropriate number of capacitive modules 22, 24, 26 which are to be inserted in series with the transmission line 12 to change the line impedance Z from a positive value (with a dominant inductance) to a negative impedance (where the capacitance is dominant). However, the magnitude of the negative impedance must be greater than $Z_{C\text{-}MIN}$ shown in FIG. 4. Thus, it is the capacitance matching portion 100 which determines the magnitude of capacitive impedance $Z_C$ to insert in series with the line to avoid the overcurrent conditions illustrated in FIG. 4.

Having illustrated and described the principles of my invention with respect to a preferred embodiment, it should be apparent to those skilled in the art that my invention may be modified in arrangement and detail without departing from such principles. For example, other arrangements for the capacitor 20 may be used, and other arrangements and types of switching devices 30, and modified arrangements for controller 50, each known to be structurally equivalent by those skilled in the art, may be substituted for the arrangements described herein. I claim all such modifications falling within the scope and spirit of the following claims.

I claim:

1. A power flow control system to control the direction of power flow on a transmission line, comprising:

a capacitor;

a switching device to selectively couple said capacitor to said transmission line;

a sensor for monitoring current flowing through said transmission line; and a controller responsive to said sensor to actuate said switching device, said controller including a line current limiter to identify line current on said transmission line above a specified maximum current magnitude limit, a deadband control device responsive to said sensor to establish a deadband range of impedance values and an operative range of impedance values for said transmission line, said operative range of impedance values including negative reactance impedance values and positive reactance impedance values, said line current limiter and said deadband control device generating output signals that are applied to said switching device such that said switching device selectively couples said capacitor to said transmission line to maintain said line current on said transmission line below said specified maximum current magnitude limit, and to maintain said transmission line impedance within said operative range of impedance values and outside of said deadband range of impedance values, and thereby vary said capacitor's reactive power compensation to said transmission line in such a manner as to control the direction of power flow on said transmission line.

2. The power flow control system of claim 1 wherein:

said capacitor forms a portion of a plurality of capacitor modules; and said switching device forms a portion of a plurality of switching modules, each of said switching modules of said plurality of switching modules being connected in parallel to a corresponding capacitor of said plurality of capacitor modules.

3. The power flow control system of claim 2 further including one or more inductors in series with one or more of said plurality of switching modules.

4. A method of controlling the direction of power flow on a transmission line, comprising the steps of:

sensing current flow through a transmission line to establish a sensed current signal;

comparing said sensed current signal to a specified maximum current magnitude limit and generating a maximum current control signal to maintain said current flow through said transmission line below said maximum current magnitude limit;

comparing the impedance of said transmission line with a deadband range of impedance values and an operative range of impedance values for said transmission line, said operative range of impedance values including positive reactance impedance values and negative reactance impedance values, said comparing step including the step of generating a deadband control signal to maintain said transmission line impedance within said operative range of impedance values and outside of said deadband range of impedance values; and applying said maximum current control signal and said deadband control signal to a switching device that selectively connects a capacitor to said transmission line so as to vary said capacitor's reactive power compensation to said transmission line in such a manner as to control the direction of power flow on said transmission line.

5. The method of claim 4 further comprising the steps of:

applying said maximum current control signal and said deadband control signal to a plurality of switching modules, each of said switching modules including a switching device connected in parallel with a capacitor.

* * * * *